US006846219B2

(12) United States Patent
Moyer

(10) Patent No.: US 6,846,219 B2
(45) Date of Patent: Jan. 25, 2005

(54) RIGID FRAME BRASSIERE WITH SOFT CUP

(75) Inventor: Phoebe Simonski Moyer, Scotch Plains, NJ (US)

(73) Assignee: Sara Lee Intimate Apparel, Winston-Salem, NC (US)

( * ) Notice: Subject to any disclaimer, the term of this patent is extended or adjusted under 35 U.S.C. 154(b) by 3 days.

(21) Appl. No.: 10/242,798

(22) Filed: Sep. 13, 2002

(65) Prior Publication Data

US 2004/0053557 A1 Mar. 18, 2004

(51) Int. Cl.[7] ..... A41C 3/00
(52) U.S. Cl. ..... 450/41; 450/39; 450/86
(58) Field of Search ..... 450/41–48, 53, 450/86, 92, 93, 39, 40; 2/267, 268, 73, 78.1–78.3, 323–327, 310, 318, 336, 338

(56) References Cited

U.S. PATENT DOCUMENTS

| | | | | | |
|---|---|---|---|---|---|
| 2,109,172 | A | | 2/1938 | Green et al. | 2/42 |
| 2,485,313 | A | | 10/1949 | Rabinowitz | 2/42 |
| 159,505 | A | | 8/1950 | McKeefrey | D20/4 |
| 2,895,481 | A | | 7/1959 | Spitzer | 128/476 |
| 2,973,764 | A | | 3/1961 | Steiner | 128/476 |
| 2,992,646 | A | * | 7/1961 | Weinberg | 450/41 |
| 3,062,216 | A | * | 11/1962 | Stein | 450/41 |
| 3,108,598 | A | | 10/1963 | Sachs | 128/516 |
| 202,267 | A | | 9/1965 | Maas | D20/4 |
| 3,291,132 | A | | 12/1966 | Puliafico | 128/483 |
| 3,320,959 | A | | 5/1967 | Fridolph | 128/451 |
| 3,358,691 | A | | 12/1967 | Hayes | 128/510 |
| 3,378,012 | A | | 4/1968 | Schwartz | 128/476 |
| 3,393,681 | A | | 7/1968 | Sachs | 128/483 |
| 220,897 | A | | 6/1971 | Pioli | D2/2 |
| 3,789,098 | A | | 1/1974 | Cole et al. | 264/103 |
| 3,873,403 | A | | 3/1975 | Edelman | 161/76 |
| 265,141 | A | | 6/1982 | Stern et al. | D2/24 |
| 4,375,445 | A | | 3/1983 | Cole et al. | 264/250 |
| 4,432,364 | A | | 2/1984 | Martini | 128/484 |
| 279,726 | A | | 7/1985 | Nienstedt et al. | D2/24 |
| 4,572,195 | A | | 2/1986 | Hyams | 128/463 |
| 4,617,934 | A | * | 10/1986 | Hittel | 450/41 |
| 4,945,571 | A | * | 8/1990 | Calvert | 2/455 |
| 5,165,113 | A | * | 11/1992 | Hyams et al. | 2/268 |
| 5,215,494 | A | | 6/1993 | Flanagan | 450/61 |
| 6,439,959 | B1 | | 8/2002 | Magrone et al. | 450/41 |

* cited by examiner

*Primary Examiner*—Gloria M. Hale
(74) *Attorney, Agent, or Firm*—Ohlandt, Greeley, Ruggiero & Perle

(57) ABSTRACT

There is provided a brassiere that includes a body having a pair of breast cups, a rigid frame positioned adjacent to the side and bottom perimeters of the breast cups to act as a stabilizer for the breast cups, and a pair of back panels, each connected to an outer edge of the frame. Preferably, the frame supporting the breast cups is made of a rigid polyester material. The brassiere may further include a pair of shoulder straps.

27 Claims, 5 Drawing Sheets

RIGID FRAME BRASSIERE WITH SOFT CUP

BACKGROUND OF THE INVENTION

1. Field of the Invention

The present invention relates to brassieres. Particularly, the present invention relates to a brassiere having a rigid or stabilized frame that reinforces each breast cup to provide support for the breast of the wearer without the need for an underwire.

2. Description of the Prior Art

To be comfortable, a brassiere must combine both support for the wearer's breasts and freedom of movement for the wearer's body.

To provide freedom of movement to the wearer, some brassieres include a high percentage of stretchable materials, such as elastic. However, brassieres formed primarily of stretchable fabric may not provide sufficient breast support.

To achieve a suitable level of support for the breast, most brassieres use support underwires and/or non-stretchable fabric in certain areas. However, support underwires, especially when secured in place by non-stretchable material, can become an impediment to an active wearer. Moreover, support underwires, especially during movement by an active wearer, may poke through the fabric of the brassiere.

There are brassieres that attempt to combine support and freedom of movement. For example, some brassieres place the underwires in an inner panel next to the skin, so that the underwires are spaced apart from the material forming the breast cups. However, this configuration increases the complexity of the brassiere, and may do little to overcome the dual problem of achieving flexibility and support.

Given the foregoing, there is a need for a brassiere that provides freedom of movement without discomfort, as well as support for the breasts, during all activities of the wearer.

SUMMARY OF THE INVENTION

It is an object of the present invention to provide a brassiere that has freedom of movement without adversely effecting the brassiere's ability to support the wearer's breast.

It is another object of the present invention to provide such a brassiere that has a frame that stabilizes and supports, at least at the bottom portion of the brassiere.

It is yet another object of the present invention to provide full bust support.

It is still another object of the present invention to provide a brassiere that has an adjustable fit.

It is a further object of the present invention to provide such a brassiere that may have stretchable back panels.

It is still a further object of the present invention to provide such a brassiere that has a frame that supports the breast cups and eliminates the need for an underwire to provide support for the breasts of the wearer thereby enhancing natural shaping and comfort.

These and other objects and advantages of the present invention are achieved by a brassiere that includes a body having a pair of breast cups, a rigid frame positioned adjacent to the side and bottom perimeters of the breast cups to act as a stabilizer and/or support for the breast cups, and a pair of back panels. The frame acts as a stabilizing band that provides support to the breast cups of the brassiere, and thus the breasts of the wearer, and also functions similar to and as an underwire. However, the present invention avoids the use of underwires. Preferably, the frame supporting the breast cups is made of a rigid polyester material. The brassiere may further include a pair of shoulder straps, with each strap connected to a breast cup and a side panel. In a preferred embodiment, the shoulder strap has a curvilinear shaped area that is wider than a conventional brassiere strap in order to increase the size of the load bearing region of the wearer's shoulder.

DETAILED DESCRIPTION OF THE INVENTION

Figure 1:
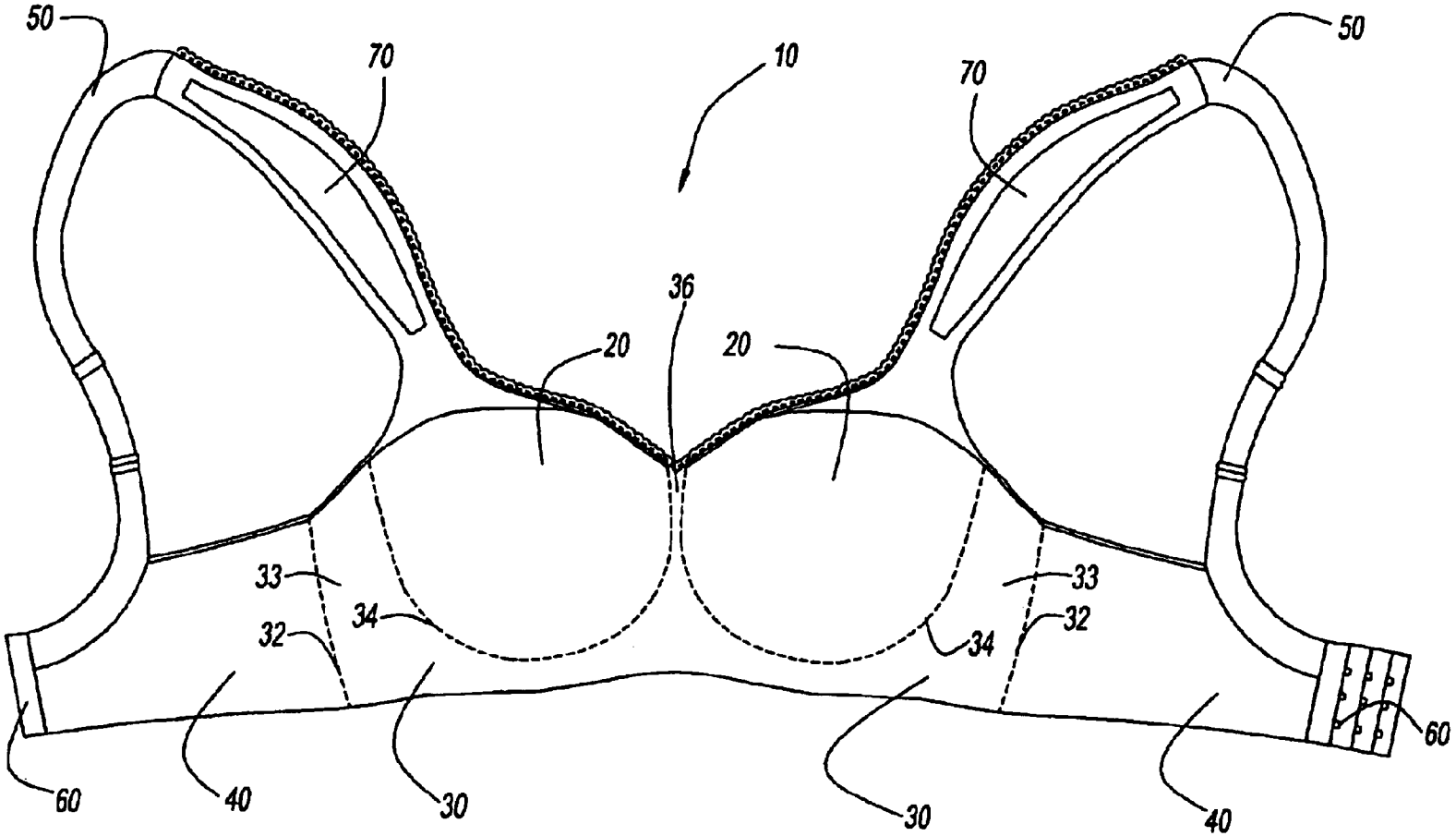
FIG. 1 is a front view of the brassiere according to the present invention.

Referring to the drawings and, in particular, FIG. 1, there is provided a brassiere according to the present invention, generally represented by reference numeral 10. Brassiere 10 has a body with a pair of breast cups 20, a frame 30 that supports each breast cup 20, and a pair of back panels 40, each connected at one end to an outer edge or seam 32 of frame 30 and at the other end adapted to be connected together. Brassiere 10 may also have a pair of shoulder straps 50, each connected to a different breast cup 20 and back panel 40.

Each breast cup 20 has two sides. A first side contacts the body of the wearer, while a second side faces away from the body of the wearer. Preferably, each breast cup 20 is made of a polyester material. More preferably, the polyester material is made of 100% polyester. In this preferred embodiment, the polyester material of breast cup 20 is substantially non-stretchable in the horizontal and vertical directions. However, each breast cup 20 may be made of stretchable materials or cut and sew materials with various combinations of stretch and/or non-stretch characteristics. In the preferred embodiment, the polyester material of the first side of breast cup 20 has a smooth finish, while the polyester material of the second side has a textured satin finish. However, any finish of either of the first and second sides is possible.

Each back panel 40 is preferably peripherally connected to frame 30. Each back panel 40 is preferably made from one piece of stretchable material. Preferably, the stretchable material is stretchable in only a horizontal direction, and substantially non-stretchable in the vertical direction. More preferably, the stretchable material is stretchable in both the horizontal and vertical directions. However, each back panel 40 can be made of a non-stretchable or substantially non-stretchable material.

As used herein the terms "sideways," "vertical," and "horizontal" are defined in reference to the orientation of brassiere 10 as it would be positioned on a wearer's body. Thus, back panels 40 extend substantially sideways or horizontally, while shoulder straps 50 extend substantially vertically.

In a preferred embodiment, the stretchable material is a mesh knit. The function of back panel 40 is to provide horizontal stretch (across the body or along the waistline)

around the torso of the wearer. Each back panel 40 encircles the remainder of the torso of the wearer. Back panels 40 are removably joined together by conventional fasteners 60, such as, for example, hook-and-eye closures. It should also be noted that back panel 40 may have one or more components; thus back panel 40 may include a separate side panel.

Figure 2:
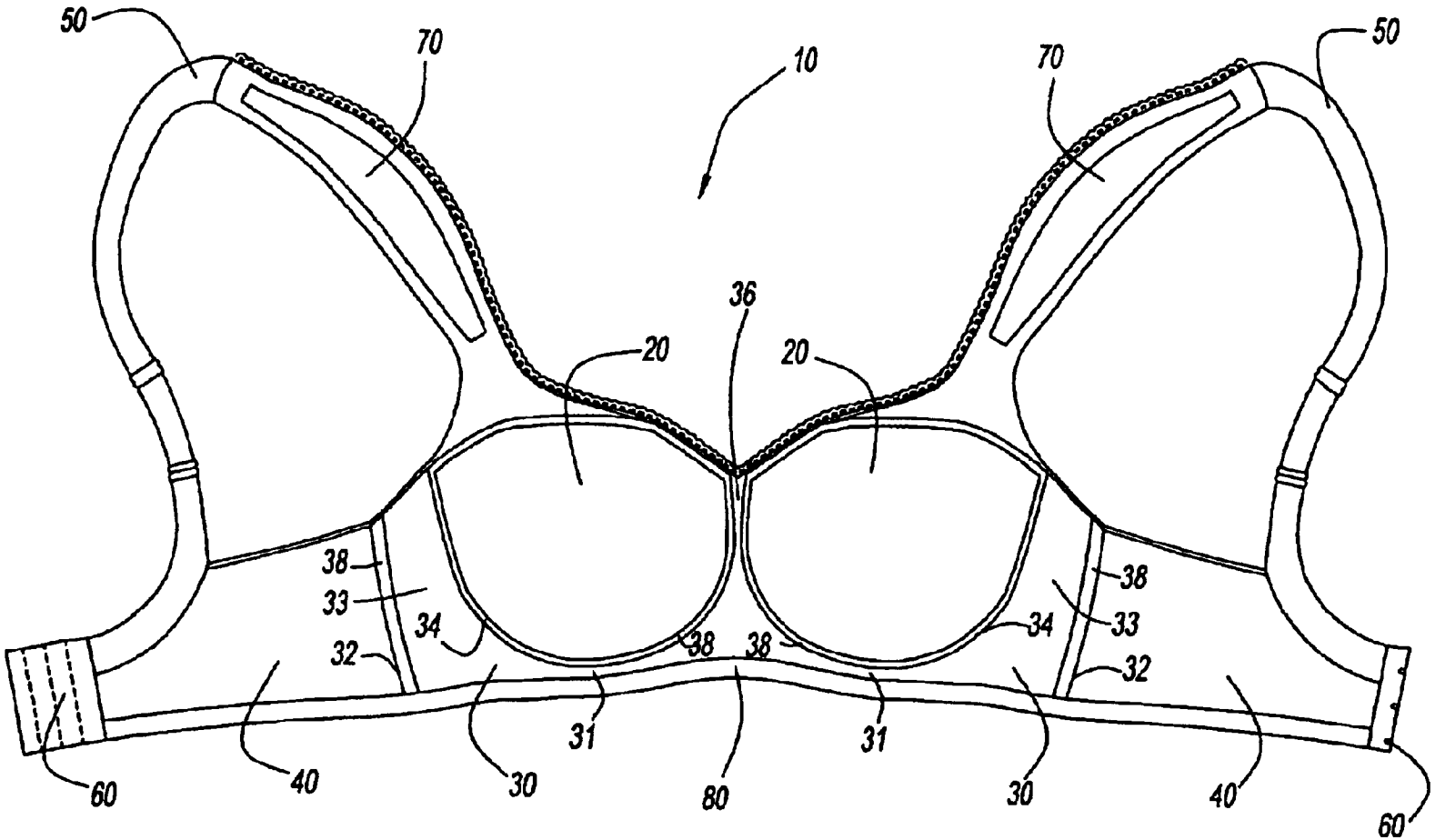
FIG. 2 is a rear fiew of the brassiere of FIG. 1.
Figure 3:
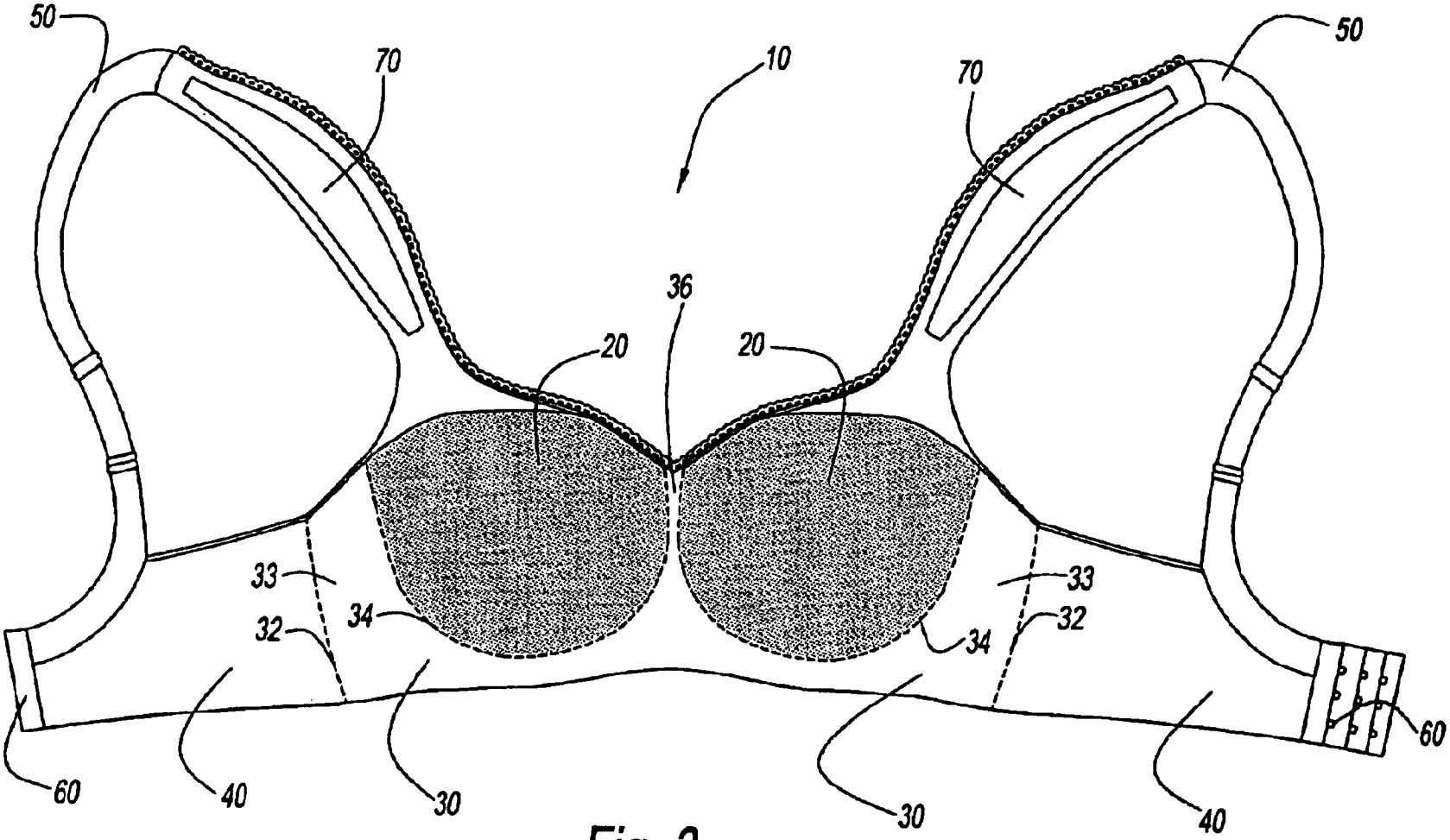
FIG. 3 is a front view of the preferred embodiment of the brassiere of FIG. 1 showing textured breast cups.
Figure 4:
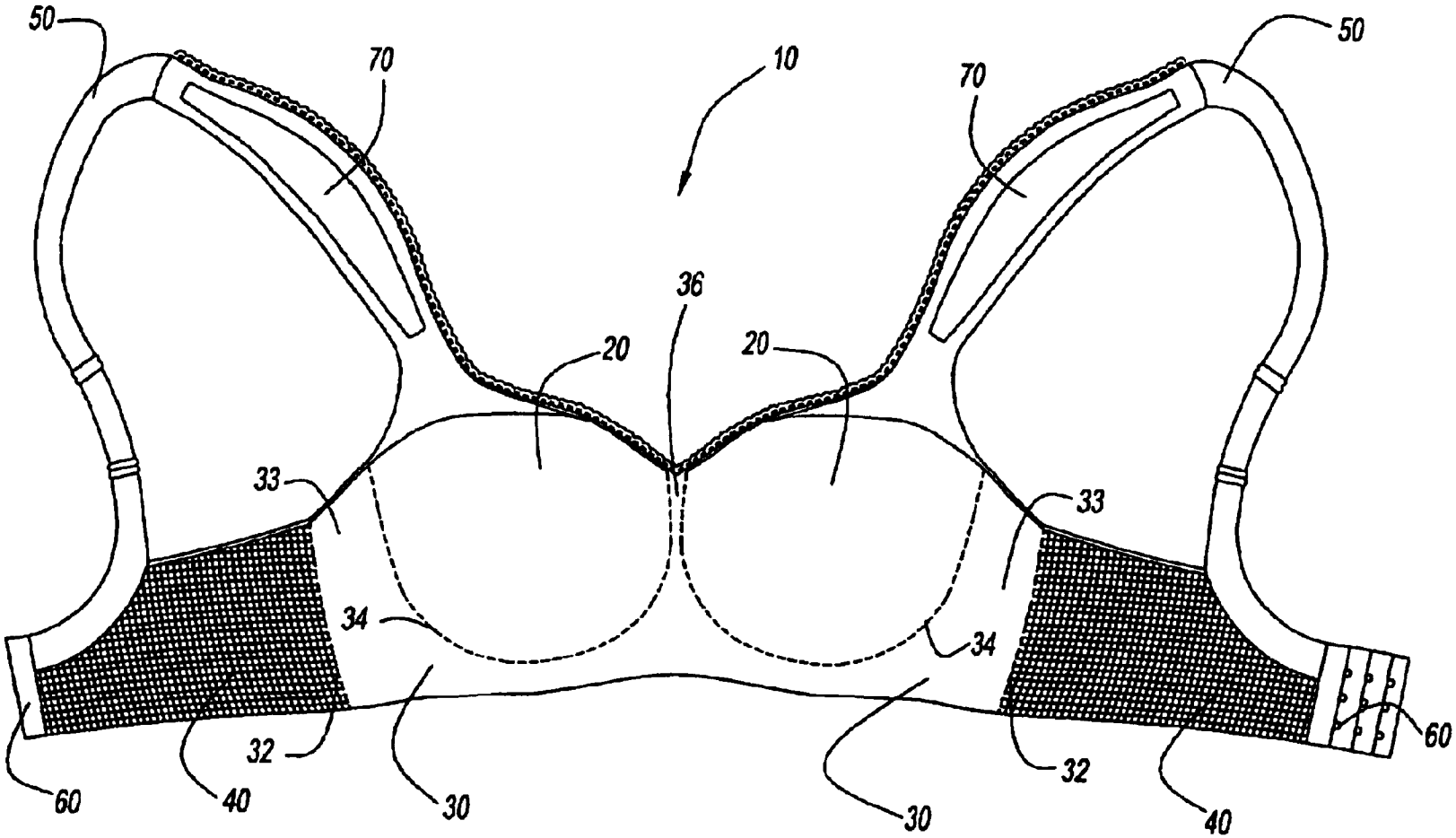
FIG. 4 is a front view of an alternate embodiment of the brassiere of FIG. 1 showing mesh knit back panels.
Figure 5:
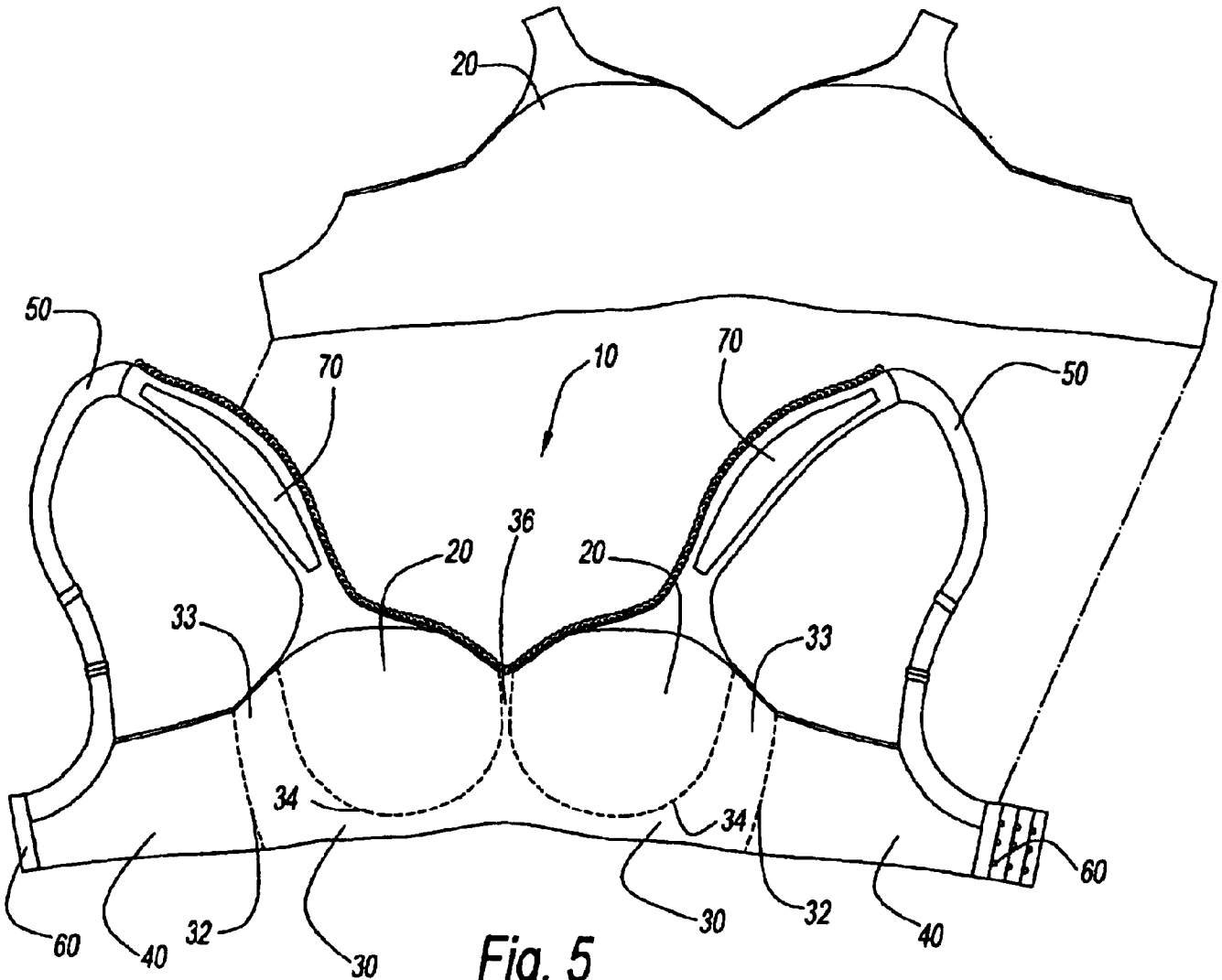
FIG. 5 is an exploded view of the brassiere of FIG. 1.

As shown in FIG. 2, the side and bottom perimeters of each breast cup 20 are supported by frame 30. Frame 30 is made of a rigid material and is non-stretchable. Frame 30 is made of a polyester material coated or impregnated with a resin. Such a material is known in the textile industry as "buckram". Preferably, the polyester material is 100% polyester. More preferably, the polyester material is a stabilized warp knit construction. The buckram material is rigid, thereby providing support and durability. Buckram is usually coated to give it a smooth, soft finish. In the present invention, the buckram material of frame 30 is laminated to a cotton blend material to make it smooth and soft, yet also firm against the body of the wearer.

Frame 30 has two side portions 33 on the dorsal side of breast cups 20, bottom portions 31 under each breast cup 20, and a central portion 36 between the breast cups. Central portion 36 functions to separate the breasts of the wearer. Central portion 36 is preferably virtually entirely between breast cups 20 in the vertical or substantially vertical direction. However, central portion 36 may only be partially between breast cups 20 should the style desire less coverage of the wearer's breasts. Central portion 36, bottom portions 31 and side portions 33 form a unitary, double U-shaped structure to support breast cups 20. Each bottom portion 31 provides support directly under each breast cup 20. Each side portion 33 and central portion 36 provide support about the sides of each breast cup 20. Thus, each breast cup 20 is virtually entirely supported by a rigid material, which emulates an underwire.

Frame 30 functions as a stabilizer band for breast cups 20 and provides support for the breasts of the wearer. Frame 30 serves the same function as an underwire, namely to stabilize breast cups 20 of brassiere 10 and support the sides and underneath areas of the breasts of the wearer. However, frame 30 has the advantage of not being as stiff as a traditional underwire and, thus, is more body friendly to the wearer.

Each side portion has an outer edge or seam 32 and an inner edge or seam 34. Outer edge 32 is peripherally connected to side panel 40. Inner edge 34 is peripherally connected to breast cup 20. A binding 38 covers outer edge 32 and inner edge 34. Binding 38 adds thickness to outer edge 32 and inner edge 34 to enhance the comfort of frame 30 against the body of the wearer. Also, binding 38 functions similar to a stay as it provides additional structure and support to outer edge 32.

Brassiere 10 preferably has a pair of shoulder straps 50 that connect to breast cups 20 and back panels 40. The shoulder straps 50 preferably are adjustable. In a preferred embodiment, each shoulder strap 50 is anatomically shaped so that it conforms to the shape of the shoulder of the wearer. In the preferred embodiment shown in FIG. 1, each shoulder strap 50 has a curvilinear shaped area 70 that is wider than a conventional brassiere strap to increase the size of the load bearing region of the wearer's shoulder. The shaped area 70 deviates from the vertical plane created by a conventional brassiere strap. This deviation permits the shaped area 70 to fit, as desired, in accordance with the contour or anatomy of a top of a shoulder of the wearer. In the preferred embodiment, shaped area 70 is in the form of an elongated oval. Also, in the preferred embodiment shaped area 70 is filled with a cushioning material, preferably a gelatinous cushioning material.

Brassiere 10 is assembled, except for fasteners 60. Namely, breast cups 20, frame 30 and back panels 40 are formed together. Then, the polyester material of the outer cup fabric of breast cups 20 is attached to frame 30. The bottom edge of the polyester material of breast cups 20 is slightly longer than the material of frame 30. The extra material is folded over the bottom edge of frame 30 and hemmed to provide a smooth bottom edge to brassiere 10. Afterwards, an elastic band 80, shown in FIG. 2, is attached to the entire bottom edge of brassiere 10 (excluding fasteners 60) and, preferably is top stitched. Thereafter, fasteners 60 are attached to brassiere 10.

The present invention having been described with particular reference to the preferred forms thereof, it will be obvious that various changes and modifications may be made without departing from the spirit and scope of the invention as defined in the appended claims.

I claim:

1. A brassiere comprising:

a pair of breast cups, each of said pair of breast cups having a first side and a second side, said first side contacting a breast of wearer, said second side being opposite said first side;

a frame positioned adjacent to a dorsal edge of each of said pair of breast cups, said frame having at least two side portions, at least two bottom portions, and a central portion, said central portion being positioned between said pair of breast cups wherein said frame is made of a polyester material coated with a resin, each of said at least two side portions being connected to a different one of said pair of breast cups; and a pair of back panels, each of said pair of back panels being connected to a different one of said at least two side portions.

2. The brassiere of claim 1, wherein said frame is made of a rigid, non-stretchable material.

3. The brassiere of claim 1, wherein said frame is made of a polyester material coated with a resin laminated to a cotton blend material.

4. The brassiere of claim 3, wherein said polyester material is a warp knit construction.

5. The brassiere of claim 1, wherein said frame is a stabilizer band for said pair of breast cups.

6. The brassiere of claim 1, wherein said frame provides support for breasts of a wearer.

7. The brassiere of claim 1, wherein said central portion of said frame separates breasts of a wearer.

8. The brassiere of claim 1, wherein said central portion of said frame is positioned between each of said pair of breast cups in a substantially vertical direction.

9. The brassiere of claim 1, wherein said central portion, said at least two bottom portions and said at least two side portions form a unitary, double U-shaped structure.

10. The brassiere of claim 1, wherein said at least two bottom portions provide support directly under each of said pair of breast cups.

11. The brassiere of claim 1, wherein said at least two side portions and said central portions provide support to said pair of breast cups.

12. The brassiere of claim 1, wherein said brassiere has a pair of shoulder straps, each of said pair of shoulder strap being connected to a different one of said pair of breast cups and back panels.

13. The brassiere of claim 12, wherein each of said pair of shoulder straps has a curvilinear shaped area positioned in said shoulder strap.

14. The brassiere of claim 13, wherein said curvilinear shaped area is filled with a cushioning material.

15. The brassiere of claim 14, wherein said cushioning material is a gelatinous material.

16. The brassiere of claim 1, wherein said pair of breast cups is made of a polyester material.

17. The brassiere of claim 16, wherein said polyester material is 100 percent polyester.

18. The brassiere of claim 16, wherein said polyester material is substantially non-stretchable in a vertical direction and substantially non-stretchable in a horizontal direction.

19. The brassiere of claim 1, wherein said pair of breast cups is made of a stretchable material.

20. The brassiere of claim 1, wherein each of said pair of breast cups has a side that is textured.

21. The brassiere of claim 1, wherein each of said pair of back panels is made of a stretchable material.

22. The brassiere of claim 21, wherein said stretchable material is a mesh knit.

23. The brassiere of claim 1, wherein each of said pair of back panels is stretchable in a horizontal direction and substantially non-stretchable in a vertical direction.

24. The brassiere of claim 1, wherein each of said pair of back panels is stretchable in a horizontal direction and stretchable in a vertical direction.

25. The brassiere of claim 1, wherein said back panel includes a side panel.

26. A method for assembling a brassiere, which comprises:

(a) attaching an outer breast cup fabric to a frame, said outer breast cup fabric being greater in length than said frame;

(b) folding said outer breast cup fabric over a bottom edge of said frame;

(c) hemming said outer breast cup fabric to said frame;

(d) attaching a pair of back panels to an outer edge of said frame; and (e) attaching an elastic band to a bottom edge of said brassiere.

27. The method of claim 26, further comprising thereafter attaching a fastener to said back panels.

* * * * *